United States Patent [19]

Jones et al.

[11] 4,401,346

[45] Aug. 30, 1983

[54] APPARATUS FOR CONTROLLING THE OPERATION OF A DOOR

[75] Inventors: Jack D. Jones, Lima, Ohio; Russell K. Glover, Jr., Tequesta, Fla.

[73] Assignee: Aircraft Dynamics Corporation, Elida, Ohio

[21] Appl. No.: 245,311

[22] Filed: Mar. 19, 1981

[51] Int. Cl.[3] ..... E05B 47/00

[52] U.S. Cl. ..... 292/144; 292/251.5

[58] Field of Search ..... 292/251.5, 144, 201

[56] References Cited

U.S. PATENT DOCUMENTS

| | | | |
|---|---|---|---|
| 2,642,504 | 6/1953 | Hascall | 200/54 |
| 2,874,960 | 2/1959 | Durbin et al. | 268/65 |
| 3,204,154 | 8/1965 | Crandell | 292/251.5 X |
| 3,751,086 | 8/1973 | Geringer | 292/144 |
| 3,796,451 | 3/1974 | Schultz | 292/263 |
| 4,134,608 | 1/1979 | Pool | 292/76 |
| 4,155,576 | 5/1979 | Kennon | 292/251.5 |

FOREIGN PATENT DOCUMENTS

| | | | |
|---|---|---|---|
| 70861 | 10/1975 | Australia | 292/251.5 |
| 7802433 | 9/1979 | Netherlands | 292/251.5 |
| 351186 | 2/1961 | Switzerland | 292/251.5 |

*Primary Examiner*—Richard E. Moore

*Attorney, Agent, or Firm*—Millard & Cox

[57] ABSTRACT

An apparatus for controlling the operation of a door provided with a door closer comprises a body of ferromagnetic material mounted on a portion of a building adjacent the door, an electromagnet mounted on the door (the positions of the electromagnet and body may be reversed), a power supply, an actuator and a timer which connects the electromagnet to the power supply upon actuation by the actuator and disconnects the electromagnet from the power supply after a predetermined interval, thereby allowing the door closer to close the door.

6 Claims, 7 Drawing Figures

APPARATUS FOR CONTROLLING THE OPERATION OF A DOOR

BACKGROUND OF THE INVENTION

In condominiums and apartment buildings in which a plurality of owners or tenants use a common entrance, it is conventional to provide at this common entrance a lockable door. Only the owners or tenants residing in the condominium or apartment building are given keys to the lock on the door, which thus serves to exclude others from entering the building, thus giving greater security to the owners or tenants. To enable the owners or tenants to admit visitors without having to leave their apartments, the door is usually provided with a remote control device which enables the owners or tenants to unlock the door without leaving their apartments, after they have ascertained the identity of the visitors by means of an intercom or other similar device.

In order that the aforementioned lockable door may provide significant security to the owners or tenants within the building, it is necessary to provide the door with an automatic door closer so that it cannot be left open either accidentally or deliberately. However, conventional automatic door closers, which close the door as soon as it is released, pose problems when an owner or tenant wishes to make a number of trips through the door within a short period of time (for example, when several trips are necessary in order to unload a large quantity of groceries from an automobile) or when the owner or tenant wishes to hold the door open for a brief interval (for example, in order to maneuver a baby carriage or a bulky piece of furniture through the door). Because it is difficult in these circumstances to hold the door open manually, the owners or tenants tend to latch or wedge the door in its open position and even after they have passed through the door their hands are fully occupied so that they cannot unlatch or remove the wedge from the door at that time. By the time they have reached their apartments, the owners or tenants may have forgotten that they have left the door open or may be too lazy to make a long trip back in order to close it. This of course completely destroys the security value of the door.

There is thus a need for apparatus capable of temporarily holding a door open so that people can pass through the door without hindrance during a short period, but which permits the door to close under the action of an automatic door closer after a short period has elapsed. The invention provides such apparatus.

SUMMARY OF THE INVENTION

The invention provides apparatus for controlling the operation of a door provided with closing means. The apparatus comprises a body of ferromagnetic material which usually will be mounted on a portion of the building adjacent the door but which can be mounted on the door itself and an electromagnet which is usually mounted on the door but which may be mounted on the building adjacent the door. The apparatus further comprises a power supply for supplying electric power to the electromagnet, a timer for timing a predetermined interval and actuating means for actuating the timing means to begin the timing of the predetermined interval. The timing means commences the supply of electric power from the power supply to the electromagnet upon actuation of the actuating means and terminates the supply of electric power to the electromagnet when the predetermined interval has elapsed, thereby permitting the automatic closing means to close the door. A person wishing to maintain the door in open position for the predetermined interval preferably, first positions the door so that the electromagnet and the body of ferromagnetic material lie adjacent one another, then actuates the actuating means so that the electromagnet is attracted to the body of ferromagnetic material, so holding the door in position until, after the predetermined interval, the timer cuts off the supply of electric power to the electromagnet, so permitting the closing means to close the door. Obviously, the actuation could occur first and then the door moved to its open position; the timer and electromagnet would still function in the same way.

It will often be found convenient to make the body of ferromagnetic material in the form of a flat, thin plate secured to the floor adjacent the door. In order that the electromagnets may be strongly attracted to this plate when the electromagnet is receiving electric power, the electromagnet must lie close to the floor. However, since the floor traversed by the part of the door bearing the electromagnet as the door opens and closes may not be completely smooth (for example, the door may pass over the edge of a carpet) problems may arise if the electromagnet is too close to the floor as the door is being opened and closed. Accordingly, it is preferred that, when the electromagnet is mounted upon the door, the electromagnet be movable between an operating position, in which it can lie adjacent the body of ferromagnetic material, and a retracted position, in which it is spaced from the body, biasing means being provided for biasing the electromagnet towards its retracted position. With this arrangement, the electromagnet adopts its operating position when it is being supplied with electric power and is attracted to the body of ferromagnetic material, but the biasing means cause the electromagnet to adopt its retracted position as the door is opening and closing, so that the electromagnet is kept well clear of the floor and thus will not come into contact with any irregularities in the floor surface as the door is opened or closed.

If the body of ferromagnetic material simply comprises a flat plate, there may be a tendency for the electromagnet to slide across the plate even though the electromagnet is energized and is thus attracting the plate. This may, in certain circumstances, tend to cause the electromagnet to slide completely off the plate, thereby allowing the door to close before the predetermined interval has elapsed. To prevent this sliding of the electromagnet across the plate, it is preferred that the plate be provided with an upstanding detent which will prevent the electromagnet sliding across the plate.

If the irregularities in the floor surface traversed by the part of the door bearing the electromagnet are large, it may be difficult to allow sufficient clearance for the electromagnet to ride over these irregularities simply by moving the electromagnet between an operating and a retracted position. In these circumstances, it is preferred that the electromagnet be accommodated within a housing pivotally mounted on the door adjacent the lower edge thereof and that a roller be rotatably mounted on the housing so that the roller rolls across the floor adjacent the lower edge of the door as the door opens and closes. With this arrangement, the apparatus can cope with quite large irregularities in the floor surface since the roller will roll over the irregularities, thus pivoting the housing and enabling the electromagnet to be lifted clear of the irregularities.

DETAILED DESCRIPTION OF THE DRAWINGS

Figure 1:
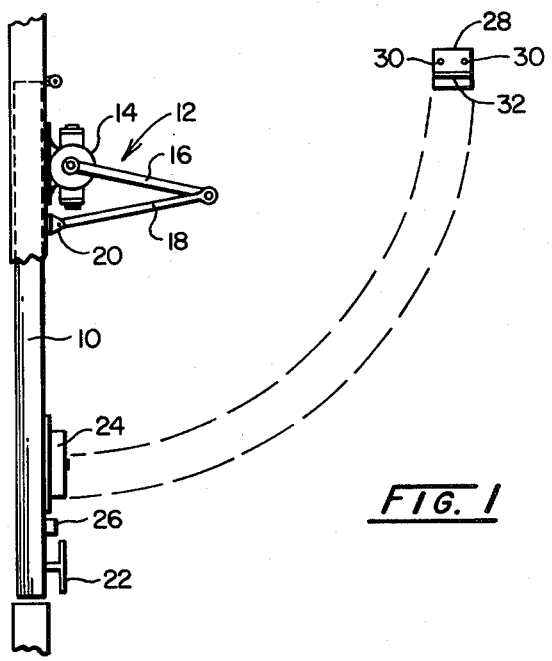
FIG. 1 is a top plan view of a door provided with closing means and apparatus of the invention, the door being shown in its closed position.

In FIG. 1, a door 10 is provided with an automatic closer 12 of a conventional type, the closer 12 comprising a module 14 attached adjacent the upper edge of the door and two arms 16 and 18 which pivotally link the module 14 to an anchoring point 20 on the lintel of the door frame. A door handle 22 is provided on the door 10 near the edge thereof remote from its hinges.

The door 10 is provided with an apparatus of the invention comprising a module 24 attached to the door adjacent the lower edge thereof and a push-button 26 disposed adjacent the handle 22. A body of ferromagnetic material 28 is secured by screws 30 to the floor of the building outside the door 10 (assuming the door opens outwardly). As indicated by the broken lines in FIG. 1, the body 28, which has the form of a flat plate upstanding only slightly from the surrounding floor, is so positioned on the floor that when the door 10 is opened to the greatest possible extent, the module 24 lies immediately above the body 28. The body 28 is provided an upstanding elongate detent 32 (see FIG. 2) whose purpose will be explained hereinafter.

Figure 2:
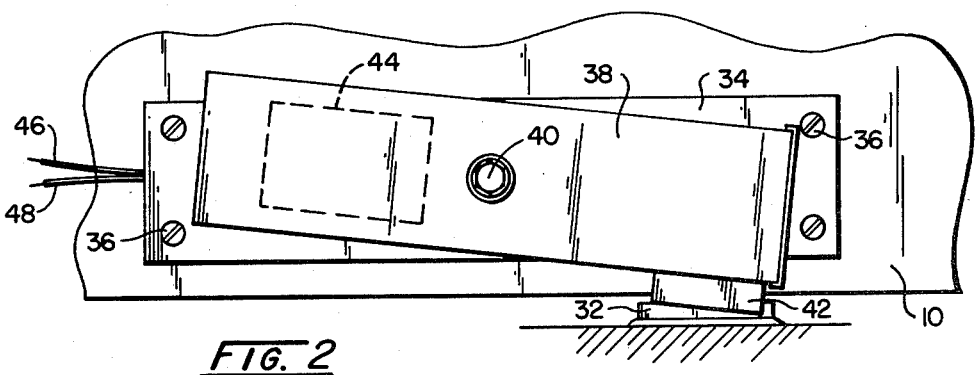
FIG. 2 is an enlarged view of the apparatus shown in FIG. 1 with the door in its open position and the electromagnet in its operating position.
Figure 3:
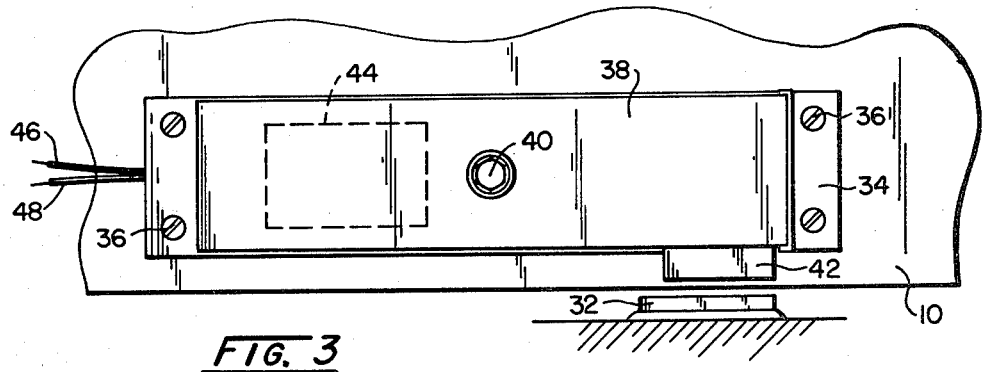
FIG. 3 is a view similar to FIG. 2 but showing the electromagnet in its retracted position.

As shown in FIGS. 2 and 3, the module 24 comprises a base plate 34 mounted by means of four screws 36 upon the door 10 adjacent the lower edge thereof. A housing 38 is mounted upon the base plate 34 by means of a pivot 40. An electromagnet 42 and a timer 44 are accommodated within the housing 38. Electrical conductors 46 and 48 are fixed to the base plate 34 and to the door 10 and supply electric power to the electromagnet 42 and the timer 44 via conventional slip rings (not shown).

The housing 38 is free to rotate about the pivot 40 and the weight distribution within the housing 38 is such that, when electric power is not being supplied to the electromagnet 42, the housing 38 tends to rotate counterclockwise in FIGS. 2 and 3 to a retracted position as shown in FIG. 3; a stop (not shown) is provided to prevent the housing 38 rotating too far. From FIG. 3, it will be seen that when the housing 38 (and thus the electromagnet 42) is in its retracted position, the lower end of the electromagnet is clear of the detent 32 on the body 28 the door closer 12 can close the door 10. Also, with the housing 38 and the electromagnet 42 in the retracted position, there is a considerable clearance between the lower end of the electromagnet 42 and the floor so that minor irregularities in the floor will not contact the lower end of the electromagnet 42 or prevent the door closing. On the other hand, when power is supplied to the electromagnet 42 and the electromagnet is adjacent the body 28, the magnetic attraction between the electromagnet 42 and the body 28 causes the housing 38 and the electromagnet 42 to adopt an operating position, as shown in FIG. 2, in which the electromagnet 42 is in contact with the flat part of the upper surface of the body 28. In this operating position, the lower end of the electromagnet 42 is below the upper edge of the detent 32 so that the detent 32 serves to prevent the electromagnet 42 from sliding off the body 28 under the force exerted by the door closer 12.

Figure 4:
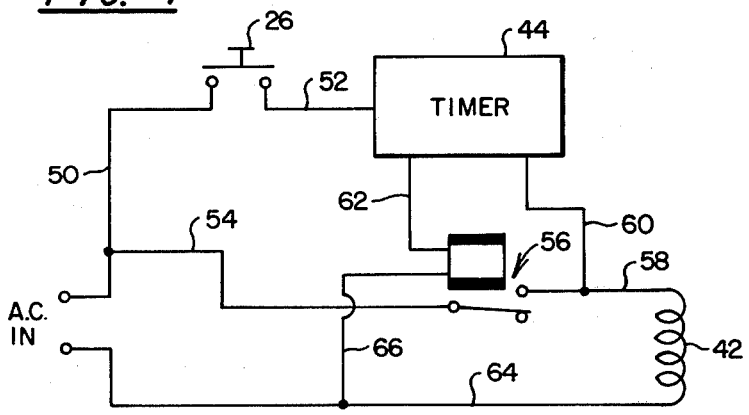
FIG. 4 shows schematically the electrical circuitry of the apparatus shown in FIGS. 1–3.

The electric circuit of the apparatus shown in FIGS. 1–3 is shown in FIG. 4. A line 50 leads from the positive side of a low-voltage D.C. supply from a transformer (not shown) to the push-button 26. From the push-button 26, a line 52 (not shown in FIGS. 2 and 3) leads to the timer 44. A line 54 extends from the line 50 to the armature of a relay 56, the other side of which is connected via line 58 to the electromagnet 42. A line 60 extends from the line 58 to the timer 44. A power supply line 62 extends from the timer 44 to the coil of the relay 56. A line 64 connects the electromagnet 42 to the negative side of the D.C. supply, while a further line 66 connects the armature of the relay 56 to the line 64, thereby connecting the armature of the relay to the negative side of the D.C. supply.

In order to keep the door 10 open for a predetermined interval, the door 10 is opened until the electromagnet 42 is directly above the body 28 and the electromagnet 42 has passed over the detent 32. The push-button 26 is then pressed, thereby connecting the timer 44 to the positive side of the D.C. supply via the lines 50 and 52. The timer 44 supplies power to the armature of the relay 56 via the line 62 and begins to count its predetermined interval. Energized relay 56 thereby interconnects lines 54 and 58 and supplies electric power to the electromagnet 42 via the line 58 and to the timer 44 via the line 60. Thus, even after the user releases the push-button 26, the power supply to the timer 44 is maintained via the line 60 and the timer continues counting.

As a result of the electric power supplied thereto, the electromagnet 42 is attracted to the body 28 and causes the housing 38 to pivot from its retracted position, which it has previously adopted, to its operating position, so that the lower end of the electromagnet 42 contacts the body 28 and the apparatus assumes the configuration shown in FIG. 2. Any tendency for the electromagnet 42 to slide across the body 28 will be eliminated as soon as the electromagnet 42 engages the detent 32.

After the predetermined interval has elapsed, the timer 44 cuts off the supply of power to the coil of the relay 56, thereby interrupting the power supply to both the electromagnet 42 and the timer 44. Since the electromagnet 42 is no longer attracted to the body 28, the housing 38 is free to pivot around the pivot 40 and to assume its retracted position, as shown in FIG. 3. Since the electromagnet 42 is now clear of the body 28 and of its upstanding detent 32, nothing is holding the door open and the door closes under the action of the door closer 12. The instant apparatus is now ready for reuse.

Figure 5:
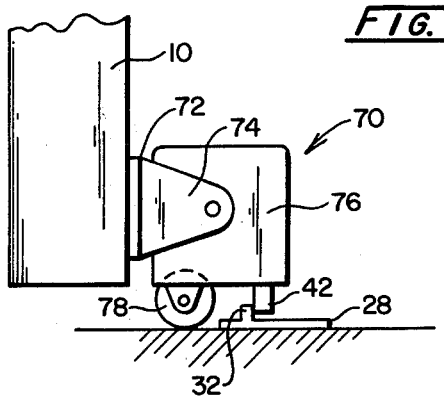
FIG. 5 shows an alternative electromagnet-carrying module which may be substituted for that shown in FIGS. 1–3.

The module (generally designated 70) shown in FIG. 5 may be substituted for the module 24 shown in FIGS.

1–3 and enables the apparatus to be used where the floor adjacent the door has quite substantial irregularities thereon. The module 70 comprises a base plate 72 which is mounted by means of screws (not shown) on a door 10 adjacent the lower edge thereof. Two brackets 74 (only one of which is visible in FIG. 5) extend outwardly from the opposed vertical edges of the base plate 72. A housing 76 is pivotally mounted between the brackets 74 and a roller 78 is rotatably mounted within the housing 78 so that it can roll across the floor as the door is opened and closed. Also accommodated within the housing 76 is an electromagnet 42 which is spring-biased upwardly by means of springs (not shown). The module 70 is used in conjunction with a body 28 of ferromagnetic material having an upstanding detent 32 and identical to that shown in FIGS. 1–4.

Figure 6:
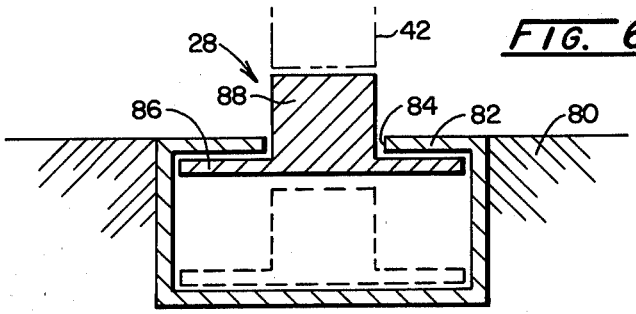
FIG. 6 is a section through an alternative type of body of ferromagnetic material which may substituted for that shown in FIGS. 1–3.

The electrical circuitry of the apparatus shown in FIG. 5 is identical to that shown in FIG. 4 and the apparatus is used in the same manner as that shown in FIGS. 1–3. When the electromagnet 42 is energized while the electromagnet lies adjacent the body 28, the electromagnet 42 moves downwardly against the spring bias and contacts the body 28, the electromagnet being prevented from sliding across the body 28 by the detent 32. However, when the electromagnet 42 is de-energized, the spring bias thereon causes the electromagnet to retract into the housing 76 and thus the electromagnet 42 moves clear of the detent 32 and the door can be closed by an automatic door closer provided thereon. If, while the door is closing, the roller 78 encounters an upstanding obstruction in the floor surface, the roller 78 will roll up and over the obstruction and will pivot the housing 76 counterclockwise in FIG. 5 around its pivot, thereby lifting the housing 76 clear of the obstruction and enabling it to pass thereover. This enables the apparatus to be used on doors adjacent floors having substantial irregularities in their surfaces.

Where the floor which the electromagnet is to traverse is smooth, it may be found more convenient to fix the electromagnet in one position relative to the door and to use a body of ferromagnetic material which is movable. A body of this type is illustrated in FIG. 6. As shown in that figure, a cylindrical recess is cut in a floor 80 and within this recess is disposed a hollow cylindrical housing 82 having a circular aperture 84 cut through its upper end face. Within the housing 82 is accommodated a member of ferromagnetic material generally designated 28 and comprising a thin, flat circular disc 86 having a diameter such that it cannot pass through the aperture 84 and an upstanding cylindrical portion 88 which extends upwardly from the disc 86 and can pass through the aperture 84. When an electromagnet 42 is disposed above the aperture 84 and energized, the member 28 is attracted to the electromagnet and rises until the member achieves an operating position wherein part of the cylindrical portion 88 protrudes from the housing 82 and the upper end face of the cylindrical portion 88 lies adjacent the electromagnet and the disc 86 is in contact with the underside of the upper end face of the housing 82, as shown in solid lines in FIG. 6. When, however, the electromagnet 42 is de-energized, the member 28 falls to the bottom of the housing 82 and adopts a retracted position wherein the member 28 lies wholly within the housing 82, as shown in broken lines in FIG. 6, so that no part of the body protrudes above the level of the floor 80, thereby reducing the risk of anybody tripping over the body. To avoid any possibility of a pedestrian catching their toe in the aperture 84, the cylindrical portion 88 of the member 28 may, if desired, be lengthened so that when the disc 86 is resting on the bottom of the housing 82, the upper end face of the cylindrical portion 88 lies flush with the upper end face of the housing 82, thereby closing the aperture 84. Clearly, the door frame itself could be of ferromagnetic material and no member 28 would be necessary.

In the apparatus of the invention shown in FIGS. 1–4, the predetermined interval is set by the timer 44 concealed within the housing 38 and cannot be varied by the user. In contrast, the apparatus shown in FIG. 7 allows the user himself to pre-select the interval during which the door will be held open. The apparatus shown in FIG. 7 comprises a first housing 90 which is attached to the door 10 adjacent the handle thereof so as to be conveniently accessible to a user. The housing 90 accommodates a timer (not shown). A spindle extends from the timer through the housing 90 and terminates in a manually rotatable knob 92. By turning the knob 92, a user can vary the interval during which the apparatus will hold the door open. A scale 94 is marked on the housing 90 adjacent the knob 92 to advise the user how much the knob 92 should be turned to produce intervals of 1 to 10 minutes. The housing 90 also accommodates a relay (not shown) which is controlled by the timer in exactly the same manner as in the apparatus shown in FIG. 4.

Figure 7:
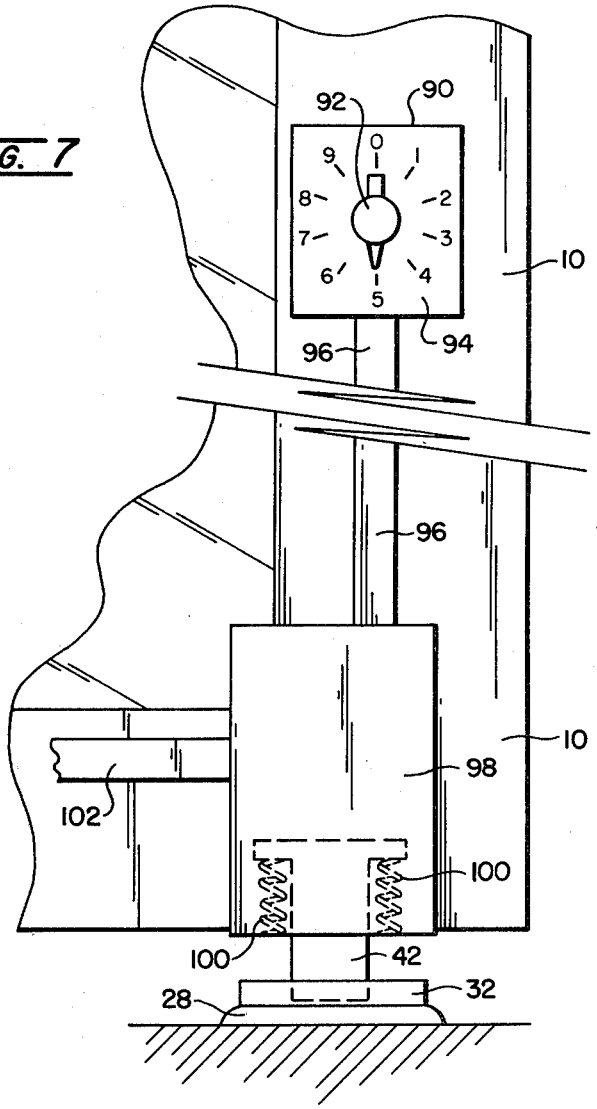
FIG. 7 is a front elevation of a further apparatus of the invention installed on a door.

From the housing 90, a conduit 96 extends downwardly to a second housing 98 attached to the door 10 adjacent the lower edge thereof. The second housing 98 contains an electromagnet 42 which is biased upwardly by means of springs 100. A body 28 of ferromagnetic material carrying a detent 32 and identical to that shown in FIGS. 1–4 is attached to the floor adjacent the housing 98 (when the door is fully open). When the housing 98 is adjacent the body 28 and the electromagnet 42 is energized by the timer, the electromagnet 42 moves downwardly against the bias of the springs 100 to an operating position in which it contacts the body 28, as shown in FIG. 7. However, when the electromagnet 42 is de-energized at the end of the selected interval, the springs 100 force the electromagnet 42 upwardly to a retracted position in which the electromagnet 42 is clear of the detent 32 and the door 10 can be closed by an automatic door closer provided thereon.

The electrical circuitry of the apparatus shown in FIG. 7 is similar to that shown in FIG. 4 except that the push-button 26 and the line 60 are omitted. The timer 44 and the relay are, as already stated, accommodated within the housing 90, and the line 58 passes through the conduit 96 from the relay to the electromagnet 42. The lines 50, 52 and 54 carry low-voltage direct current from a transformer (not shown) disposed adjacent the door 10 through flexible connectors to a conduit 102 extending across the lower part of the door to the second housing 98 and thence via conduit 96 to the timer and relay within the housing 90. The return line 66 extends down the conduit 96 to the second housing 98 where it joins the line 64 running back through the conduit 102 to the negative side of the D.C. supply.

It will be obvious to those skilled in the art that numerous modifications can be made in the apparatus described above. For example, if desired the body of ferromagnetic material may be mounted upon the door and the electromagnet set into the floor. Similarly, the body of ferromagnetic material could be mounted to pivot on the door as does the housing 38 of FIG. 2; with this modification the electromagnet of FIG. 6 may be stationary.

The body of electromagnetic material or the magnet need not be attached to the floor adjacent the door; it could be attached to a suitably positioned wall or even to a ceiling if the upper edge of the door lies adjacent the ceiling. Furthermore, various modifications could be made in the electrical circuit of the device; for example, the timer could be arranged so that the door cannot be held open during the night, when it may be undesirable to leave the door open even for a brief period. Also, although the apparatus described above requires manual operation of the actuating means by a user, it may in certain cases be desirable to ensure that the door will automatically remain open for the predetermined interval when the door is opened to an appropriate extent. To this end, the actuating means may take the form of a switch which is operated by the door as the door is opened to the appropriate extent. For example, the actuating means might take the form of a plunger such as those conventionally incorporated into the frames of automobile doors to control the interior lights thereof. Doors equipped with such apparatus may be useful in commercial or industrial premises in which they would stay open long enough to enable goods to be moved through the door but close shortly thereafter in order to prevent excessive loss of heat from the premises. Accordingly, the foregoing description is to be interpreted in an illustrative and not in a limitive sense, the scope of the invention being defined solely by the appended claims.

We claim:

1. Apparatus for controlling the operation of a door, said apparatus comprising:

a door mounted in a door frame in a vertical plane, said door having two vertically extending sides and being pivotable about one of its vertical sides between open and closed positions, mechanical means for biasing said door toward a closed position, a body of ferromagnetic material on one of said door and a portion of a building adjacent said door an electromagnet mounted on the other of said door and said portion of said building;

means for supplying electric power to said electromagnet;

means for timing a predetermined interval;

means for actuating said timing means to begin the timing of said predetermined interval, and means electrically connecting the power supply means with the timing means, said power supply means commencing the supply of electric power to said electromagnet upon actuation of said timing means and interrupting said supply of electric power to said electromagnet when said predetermined interval has elapsed, thereby permitting said biasing means to close said door, said body of ferromagnetic material including a planar surface facing toward said electromagnet when said door is in its open position, a detent projecting perpendicularly outward of said planar surface, said electromagnet and detent combining to overlap vertically when the door is open and when the timing means has been actuated, said detent abutting the electromagnet and being located in the path of the electromagnet as it is urged toward closed position by said mechanical biasing means, whereby the door cannot close because of the abutting relationship during the predetermined interval, one of said detent and electromagnet being vertically movable into the path of the other with said movement to abutment position being solely due to the power supplied to the electromagnet.

2. Apparatus according to claim 1 wherein said electromagnet and said timing means are incorporated within a single module.

3. Apparatus according to claim 1 wherein said electromagnet is mounted upon the door and is movable between an operating position, in which said electromagnet can lie adjacent said body, and a retracted position in which said electromagnet is spaced from said body, biasing means being provided for biasing said electromagnet towards its retracted position.

4. Apparatus according to claim 1, 2 or 3 further comprising a housing accommodating said electromagnet, means for pivotally mounting said housing on and door adjacent the lower edge thereof, and a roller rotatably mounted on said housing such that when said housing is mounted adjacent said lower edge of said door, said roller will roll across the floor adjacent said lower edge of said door.

5. Apparatus according to claim 1 wherein said actuating means comprises means for varying said predetermined interval.

6. Apparatus according to claim 1 wherein said body comprises a housing and a ferromagnetic member movable relative to said housing between a retracted position wherein said member lies within said housing, and an operating position, wherein part of said member protrudes from said housing.

* * * * *